US009454093B2

(12) United States Patent
Kurokawa et al.

(10) Patent No.: US 9,454,093 B2
(45) Date of Patent: Sep. 27, 2016

(54) METHOD FOR PRODUCING A POLYMERIZED TONER

(71) Applicant: ZEON CORPORATION, Tokyo (JP)

(72) Inventors: Hisashi Kurokawa, Tokyo (JP); Akihide Hagino, Tokyo (JP); Hiroyuki Taguchi, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 14/764,277

(22) PCT Filed: Jan. 24, 2014

(86) PCT No.: PCT/JP2014/051491

§ 371 (c)(1),
(2) Date: Jul. 29, 2015

(87) PCT Pub. No.: WO2014/119482

PCT Pub. Date: Aug. 7, 2014

(65) Prior Publication Data

US 2015/0370185 A1 Dec. 24, 2015

(30) Foreign Application Priority Data

Jan. 31, 2013 (JP) ..... 2013-017415

(51) Int. Cl.
*G03G 9/08* (2006.01)
*G03G 9/087* (2006.01)
*G03G 9/09* (2006.01)

(52) U.S. Cl.
CPC ..... *G03G 9/0806* (2013.01); *G03G 9/0804* (2013.01); *G03G 9/08797* (2013.01); *G03G 9/0904* (2013.01)

(58) Field of Classification Search
CPC ..... G03G 9/0804; G03G 9/0806; G03G 9/08797
USPC ..... 430/137.15
See application file for complete search history.

(56) References Cited

U.S. PATENT DOCUMENTS 5,536,612 A 7/1996 Yamaguchi et al.
5,744,278 A 4/1998 Ayaki et al.
5,952,144 A 9/1999 Hasegawa et al.

FOREIGN PATENT DOCUMENTS

JP 10-301328 A 11/1998
JP 3195362 B2 8/2001
JP 3587471 B2 11/2004

OTHER PUBLICATIONS

Notification of Transmittal of Translation of the International Preliminary Report on Patentability (Form PCT/IB/338) issued in counterpart International Applicattion No. PCT/JP2014/051491 mailed Aug. 13, 2015 with Forms PCT/IB/373 and PCT/ISA/237 (6 pages).

*Primary Examiner* — Mark A Chapman
(74) *Attorney, Agent, or Firm* — Westerman, Hattori, Daniels & Adrian, LLP

(57) ABSTRACT

Disclosed is a method for producing a polymerized toner, wherein the method comprises: a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer; a first-stage polymerization step of carrying out suspension polymerization by using the suspension, in the presence of a polymerization initiator; and a second-stage polymerization step of carrying out suspension polymerization by further adding a second-stage polymerizable monomer satisfying the following formula (1), when a polymerization conversion rate in the first-stage polymerization step becomes 20 to 80%:

$Tg_1 > Tg_2$. Formula (1):

7 Claims, No Drawings

METHOD FOR PRODUCING A POLYMERIZED TONER

TECHNICAL FIELD

The present invention relates to a toner for developing electrostatic images (polymerized toner), which is configured to be used in image forming devices using electrophotography, such as a copy machine, a facsimile machine and a printer.

BACKGROUND ART

A method for forming a desired image by developing an electrostatic latent image with a toner for developing electrostatic images, has been widely used. For example, in electrophotography, an electrostatic latent image formed on a photoconductor is developed with a toner made from colored particles optionally containing other particles of an external additive, carrier, etc. Then, the developed image is transferred onto a recording medium such as a paper or OHP sheet and then fixed to obtain a printed product.

Various kinds of properties as described below are required of toners.

First, high speed printing is required of electrophotographic copy machines, printers and so on, as well as low power consumption. In electrophotography, a process that involves particularly high energy consumption is a process of fixing a toner transferred onto a transfer material such as paper, that is, a so-called fixing process. In general, a heat roller at 150° C. or more is used for fixation, and energy consumption of the fixing process can be reduced by decreasing the temperature of the heat roller. To respond to high speed printing, it is needed to increase fixing temperature, so that the time required for the transfer material such as paper to pass through a fixing roller, is shortened. However, in this case, there is a problem of increase in energy consumption. To satisfy both the demands for low power consumption and high speed printing, it is increasingly essential to decrease toner fixing temperature.

Other properties required of toners include stable image properties even under various kinds of environments such as a high temperature and high humidity environment and a low temperature and low humidity environment (environmental stability) and no image deterioration even when making a large number of prints (printing durability).

In general, toners are broadly classified into a toner produced by a pulverization method and a toner produced by a polymerization method.

In the pulverization method, colored resin particles are produced by a method of pulverizing and classifying a solid colored resin product, which is obtained by melt-kneading a binder resin and a colorant or polymerizing a mixture containing a monomer and a colorant.

As the polymerization method, for example, there may be mentioned a suspension polymerization method in which colored resin particles are produced by forming and polymerizing droplets of a polymerizable monomer composition containing a polymerizable monomer and a colorant, and an emulsion polymerization aggregation method in which colored resin particles are produced by polymerizing an emulsified polymerizable monomer to obtain resin fine particles and aggregating the fine particles with a colorant, etc. While the form of the colored resin particles obtained by the pulverization method is not uniform, the form of the colored resin particles obtained by the polymerization method is close to a spherical form, and the particles have a small particle diameter and a narrow particle size distribution. Especially from the viewpoint of improving image quality such as image reproducibility and fineness, toners with a highly-controlled form and particle size distribution, like toners produced by the polymerization method (i.e., polymerized toner), have been increasingly used. Moreover, as a toner structure having both low-temperature fixability and heat-resistant storage stability, a so-called core-shell structure has been proposed, in which a resin having a low glass transition temperature is covered with a resin having a high glass transition temperature.

For example, in Patent Literature 1, a method for producing toner particles by a suspension polymerization method is proposed, in which, at first, polymer particles that have a glass transition temperature of 80° C. or less are formed as the core component (core particles), and a monomer that can form a polymer having a higher glass transition temperature than the polymer of the core component is added to keep polymerization reaction and form a coating layer of the shell component having a high glass transition temperature on the core component, thereby producing a capsule type toner.

In Patent Literature 2, a method for producing a thermo-compression fixing capsule toner is proposed, which is composed of a hot-melt core material containing a thermoplastic resin and a colorant, and an outer shell covering the surface of the core material, the method having the steps of: dispersing a raw material for constituting the core material and a hydrophilic shell material in an aqueous dispersion medium; producing encapsulated particles composed of the core material covered with the hydrophilic shell material by in situ polymerization and using them as precursor particles; adding at least a vinyl polymerizable monomer and a vinyl polymerization initiator to the aqueous suspension of the precursor particles to be absorbed into the precursor particles; and then polymerizing the monomer component of the precursor particles.

However, the toners of these patent literatures are insufficient to provide toners for developing electrostatic images, which have both heat-resistant storage stability and low-temperature fixability.

CITATION LIST

Patent Literature 1: JP Patent No. 3,195,362
Patent Literature 2: JP Patent No. 3,587,471

SUMMARY OF INVENTION

Technical Problem

An object of the present invention is to provide a method for producing a polymerized toner having an excellent balance between heat-resistant storage stability and low-temperature fixability.

Solution to Problem

The inventors of the present invention have found that the above problem can be solved by adding a part of a polymerizable monomer at a specific time in the production of a polymerized toner.

According to the present invention, a first method for producing a polymerized toner is provided, wherein the method comprises: a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer; a first-stage polymerization step of carrying out suspension polymerization by using the suspension, in the presence of a polymerization initiator; and a second-stage polymerization step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is a glass transition temperature (° C.) of a polymer polymerized from the first-stage polymerizable monomer, and $Tg_2$ is a glass transition temperature (° C.) of a polymer polymerized from the second-stage polymerizable monomer.

Also according to the present invention, a second method for producing a polymerized toner is provided, wherein the method comprises: a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer; a first-stage polymerization step of carrying out suspension polymerization by using the suspension, in the presence of a polymerization initiator; a second-stage polymerization step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is a glass transition temperature (° C.) of a polymer polymerized from the first-stage polymerizable monomer, and $Tg_2$ is a glass transition temperature (° C.) of a polymer polymerized from the second-stage polymerizable monomer; and a third-stage polymerization step of carrying out suspension polymerization by further adding a polymerization initiator and a third-stage polymerizable monomer satisfying the following formula (2), when a polymerization conversion rate until the second-stage polymerization step becomes 95% or more:

$$Tg_{1+2} < Tg_3 \quad \text{Formula (2):}$$

wherein $Tg_{1+2}$ is a glass transition temperature (° C.) of a polymer polymerized from the first-stage and second-stage polymerizable monomers, and $Tg_3$ is a glass transition temperature (° C.) of a polymer polymerized from the third-stage polymerizable monomer.

In the present invention, it is preferable that a mass ratio of the first-stage polymerizable monomer to the second-stage polymerizable monomer is the first-stage polymerizable monomer:the second-stage polymerizable monomer=60:40 to 95:5.

In the present invention, it is preferable that in the formula (1), $Tg_1$ is 5° C. to 250° C. higher than $Tg_2$.

In the present invention, it is preferable that in the formula (2), $Tg_3$ is 10° C. to 100° C. higher than $Tg_{1+2}$.

Advantageous Effects of Invention

According to the above-described polymerized toner production method of the present invention, a polymerized toner having an excellent balance between heat-resistant storage stability and low-temperature fixability can be obtained by carrying out further polymerization by, when the polymerization conversion rate in the first-stage polymerization step reaches the specific range, adding the second-stage polymerizable monomer which constitutes the polymer having the glass transition temperature $Tg_2$ that is lower than the glass transition temperature $Tg_1$ of the polymer polymerized from the first-stage polymerizable monomer.

DESCRIPTION OF EMBODIMENTS

The first method for producing a polymerized toner according to the present invention has: a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer; a first-stage polymerization step of carrying out suspension polymerization by using the suspension, in the presence of a polymerization initiator; and a second-stage polymerization step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is a glass transition temperature (° C.) of a polymer polymerized from the first-stage polymerizable monomer, and $Tg_2$ is a glass transition temperature (° C.) of a polymer polymerized from the second-stage polymerizable monomer.

The second method for producing a polymerized toner according to the present invention has: a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer; a first-stage polymerization step of carrying out suspension polymerization by using the suspension, in the presence of a polymerization initiator; a second-stage polymerization step of carrying out suspension polymerization by further adding a second-stage polymerizable monomer satisfying the above formula (1), when a polymerization conversion rate in the first-stage polymerization step becomes 20 to 80%; and a third-stage polymerization step of carrying out suspension polymerization by further adding a polymerization initiator and a third-stage polymerizable monomer satisfying the following formula (2), when a polymerization conversion rate until the second-stage polymerization step becomes 95% or more:

$$Tg_{1+2} < Tg_3 \quad \text{Formula (2):}$$

wherein $Tg_{1+2}$ is a glass transition temperature (° C.) of a polymer polymerized from the first-stage and second-stage polymerizable monomers, and $Tg_3$ is a glass transition temperature (° C.) of a polymer polymerized from the third-stage polymerizable monomer.

The second production method is a combination of the above-mentioned first production method with the third-stage polymerization step. Hereinafter, the first production method will be described. It should be noted that the description of the third-stage polymerization step also serves as the description of the second production method.

Hereinafter, the polymerized toner produced by the production method of the present invention will be described.

The polymerized toner obtained by the present invention contains colored resin particles containing at least a binder resin polymerized from the first-stage and second-stage polymerizable monomers, and a colorant.

Hereinafter, a method for producing colored resin particles used in the present invention, colored resin particles obtained by the production method, a method for producing the polymerized toner of the present invention containing the colored resin particles, and the polymerized toner obtained by the production method, will be explained in order.

1. The Method for Producing Colored Resin Particles

The colored resin particles used in the present invention can be produced by a suspension polymerization method containing the following process.

1-1. The Step of Preparing a First-Stage Polymerizable Monomer Composition

First, a first-stage polymerizable monomer, a colorant and, if necessary, other additive(s) such as a charge control agent, are mixed to prepare a first-stage polymerizable monomer composition. In the preparation of the first-stage polymerizable monomer composition, the mixing is conducted by a media type dispersing machine, for example.

In the present invention, "polymerizable monomer" means a monomer having a polymerizable functional group, and the polymerizable monomer is polymerized into a binder resin. It is preferable to use a monovinyl monomer as a main component of the polymerizable monomer. Examples of the monovinyl monomer include the following: styrene; styrene derivatives such as vinyltoluene and α-methylstyrene; acrylic acids and methacrylic acids; acrylic esters such as methyl acrylate, ethyl acrylate, propyl acrylate, butyl acrylate, 2-ethylhexyl acrylate and dimethylaminoethyl acrylate; methacrylic esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers can be used alone or in combination of two or more kinds. Of these monovinyl monomers, styrene, styrene derivatives and acrylic esters or methacrylic esters are preferably used as the monovinyl monomer.

In the present invention, the first-stage polymerizable monomer means a polymerizable monomer which is one of the polymerizable monomers used in the present invention and is used from the first-stage polymerization step (that is, the first polymerization step) for polymerization.

To prevent hot offset and improve storage stability, it is preferable to use any cross-linkable polymerizable monomer in combination with the monovinyl monomer. The cross-linkable polymerizable monomer means a monomer having two or more polymerizable functional groups. Examples of the cross-linkable polymerizable monomer include: aromatic divinyl compounds such as divinylbenzene, divinylnaphthalene and derivatives thereof; ester compounds such as ethylene glycol dimethacrylate and diethylene glycol dimethacrylate, in which two or more carboxylic acids having a carbon-carbon double bond are esterified to an alcohol having two or more hydroxyl groups; other divinyl compounds such as N,N-divinylaniline and divinyl ether; and compounds having three or more vinyl groups. These cross-linkable polymerizable monomers can be used alone or in combination of two or more kinds.

In the present invention, the cross-linkable polymerizable monomer is generally used in an amount of 0.1 to 3 parts by mass, preferably 0.3 to 2 parts by mass, relative to the total amount 100 parts by mass of the monovinyl monomer used in the present invention.

Also, it is preferable to use a macromonomer further as a part of the polymerizable monomer, because the toner thus obtained has an excellent balance between storage stability (heat resistance) and low-temperature fixability. A macromonomer is one having a polymerizable carbon-carbon unsaturated double bond at an end of a molecular chain thereof, and it is also a reactive oligomer or polymer generally having a number average molecular weight of 1,000 to 30,000. The macromonomer is preferably one that gives a polymer having a higher glass transition temperature (hereinafter may be referred to as "Tg") than that of the polymer obtained by polymerizing the above-mentioned monovinyl monomer. The macromonomer is preferably used in an amount of 0.03 to 5 parts by mass, more preferably 0.05 to 1 part by mass, relative to the total amount 100 parts by mass of the monovinyl monomer used in the present invention.

A colorant is used in the present invention. In the case of producing a color toner, black, cyan, yellow and magenta colorants can be used.

As the black colorant, for example, there may be used carbon black, titanium black, and magnetic powders of zinc iron oxide, nickel iron oxide and so on.

As the cyan colorant, for example, there may be used copper phthalocyanine compounds, derivatives thereof, and anthraquinone compounds. Concrete examples include C.I. Pigment Blue 2, 3, 6, 15, 15:1, 15:2, 15:3, 15:4, 16, 17:1 and 60.

As the yellow colorant, for example, there may be used compounds including condensation polycyclic pigments and azo-based pigments such as monoazo pigments, disazo pigments, etc. Examples thereof include C.I. Pigment Yellow 3, 12, 13, 14, 15, 17, 62, 65, 73, 74, 83, 93, 97, 120, 138, 155, 180, 181, 185, 186 and 213.

As the magenta colorant, for example, there may be used compounds including condensation polycyclic pigments and azo-based pigments such as monoazo pigments, disazo pigments, etc. Examples thereof include C.I. Pigment Violet 19 and C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269.

In the present invention, the colorants can be used alone or in combination of two or more kinds. The colorant is preferably used in an amount of 1 to 10 parts by mass, relative to the total amount 100 parts by mass of the monovinyl monomer used in the present invention.

From the viewpoint of improving the releasing characteristics of the toner from a fixing roller upon fixing, it is preferable to add a release agent to the polymerizable monomer composition. The release agent is not particularly limited, as long as it is one that is generally used as a release agent for toner.

The release agent preferably contains at least one of an ester wax and a hydrocarbon wax. By using these waxes as the release agent, a suitable balance between low-temperature fixability and storage stability can be obtained. The melting point of the release agent is preferably 55 to 85° C., more preferably 60 to 75° C., which is measured by differential scanning calorimetry (DSC).

In the present invention, preferably used as the release agent is a polyfunctional ester wax. Examples thereof include: pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate, and glycerin tribehenate; and dipentaerythritol ester compounds such as dipentaerythritol hexamyristate and dipentaerythritol hexapalmitate.

Also in the present invention, preferably used as the release agent is a hydrocarbon wax. Examples thereof include a polyethylene wax, a polypropylene wax, a Fischer-Tropsch wax and a petroleum wax. Of them, preferred are a Fischer-Tropsch wax and a petroleum wax, and more preferred is a petroleum wax. As the petroleum wax, there may be mentioned a paraffin wax, a microstalline wax and petrolatum. Of them, preferred is a paraffin wax.

The hydrocarbon wax preferably has a number average molecular weight of 300 to 800, more preferably 400 to 600. The hydrocarbon wax preferably has a penetration of 1 to 10, more preferably 2 to 7, which is measured according to JIS K2235 5.4.

Besides the above release agents, for example, there may be used a natural wax such as jojoba and a mineral wax such as ozokerite.

As the release agent, the above-mentioned waxes can be used alone or in combination of two or more kinds.

The release agent is preferably used in an amount of 0.1 to 30 parts by mass, more preferably 1 to 20 parts by mass, relative to the total amount 100 parts by mass of the monovinyl monomer used in the present invention.

To increase toner chargeability, a positively- or negatively-chargeable charge control agent can be used as other additive.

The charge control agent is not particularly limited, as long as it is one that is generally used as a charge control agent for toner. Among charge control agents, preferred is a positively- or negatively-chargeable charge control resin, because it has high compatibility with polymerizable monomers and is able to impart stable chargeability (charge stability) to toner particles. From the viewpoint of obtaining a positively-chargeable toner, a positively-chargeable charge control resin is more preferably used.

Examples of positively-chargeable charge control agents include the following: nigrosine dyes, quaternary ammonium salts, triaminotriphenylmethane compounds, imidazole compounds, polyamine resins (which are charge control resins preferably used), quaternary ammonium group-containing copolymers, and quaternary ammonium base-containing copolymers.

As the negatively-chargeable charge control agent, there may be mentioned azo dyes containing metals such as Cr, Co, Al, Fe, etc., salicylate metal compounds and alkyl salicylate metal compounds. Moreover, there may be mentioned sulfonic acid group-containing copolymers, sulfonic acid base-containing copolymers, carboxylic acid group-containing copolymers, carboxylic acid base-containing copolymers and so on, which are charge control resins preferably used.

In the present invention, the charge control agent is generally used in an amount of 0.01 to 10 parts by mass, preferably 0.03 to 8 parts by mass, relative to the total amount 100 parts by mass of the monovinyl monomer used in the present invention. When the amount of the charge control agent added is less than 0.01 part by mass, fog may be produced. When the amount of the charge control agent added is more than 10 parts by mass, soiling may occur.

It is also preferable to use a molecular weight modifier as other additive, when polymerizing the polymerizable monomer into a binder resin.

The molecular weight modifier is not particularly limited, as long as it is one that is generally used as a molecular weight modifier for toner. Examples thereof include mercaptans such as t-dodecyl mercaptan, n-dodecyl mercaptan, n-octyl mercaptan and 2,2,4,6,6-pentamethylheptane-4-thiol; and thiuram disulfides such as tetramethylthiuram disulfide, tetraethylthiuram disulfide, tetrabutylthiuram disulfide, N,N'-dimethyl-N,N'-diphenylthiuram disulfide, and N,N'-dioctadecyl-N,N'-diisopropylthiuram disulfide. These molecular weight modifiers can be used alone or in combination of two or more kinds.

In the present invention, the molecular weight modifier is generally used in an amount of 0.01 to 10 parts by mass, preferably 0.1 to 5 parts by mass, relative to the total amount 100 parts by mass of the monovinyl monomer used in the present invention.

1-2. The Suspension Step for Obtaining a Suspension (Droplets Forming Step)

In this step, a suspension in which droplets of a first-stage polymerizable monomer composition containing at least a first-stage polymerizable monomer and a colorant are dispersed, is obtained by suspending the first-stage polymerizable monomer composition in an aqueous dispersion medium containing a dispersion stabilizer. The method for forming droplets is not particularly limited. For example, a machine which is capable of strong agitation is used, such as an (in-line) emulsification device (product name: MILDER; manufactured by: Pacific Machinery & Engineering Co., Ltd.), an emulsification device (product name: CAVITRON; manufactured by: Pacific Machinery & Engineering Co., Ltd.), a high-speed emulsification device (product name: T.K. Homo Mixer Mark II; manufactured by: PRIMIX Corporation), etc.

The polymerization initiator used in the first-stage polymerization step can be added after the first-stage polymerizable monomer composition is dispersed in the aqueous dispersion medium and before the droplets are formed, or it can be added to the first-stage polymerizable monomer composition before the composition is dispersed in the aqueous dispersion medium.

Examples of the polymerization initiator include: persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butyl peroxide, benzoyl peroxide, t-butylperoxy-2-ethylhexanoate, t-butylperoxy-2-methylbutanoate, t-butylperoxy-2-ethylbutanoate, t-hexylperoxy-2-ethylbutanoate, t-hexylperoxy isobutyrate, diisopropyl peroxydicarbonate, di-t-butylperoxy oxyisophthalate, and t-butylperoxy isobutyrate.

They can be used alone or in combination of two or more kinds. Of them, organic peroxides are preferably used, from the point of view that remaining polymerizable monomers can be decreased and excellent printing durability can be obtained.

Of organic peroxides, preferred are peroxy esters, and more preferred are non-aromatic peroxy esters, that is, peroxy esters having no aromatic ring, from the point of view that they have better initiator efficiency and can decrease remaining polymerizable monomers.

The added amount of the polymerization initiator used in the first-stage polymerization step, is preferably 0.1 to 20 parts by mass, more preferably 0.3 to 15 parts by mass, particularly preferably 1 to 10 parts by mass, relative to the total amount 100 parts by mass of the monovinyl monomer used in the present invention.

The polymerization initiator used in the first-stage polymerization step can also serve as the polymerization initiator used in the second-stage polymerization step. That is, it is allowed that particularly no polymerization initiator is added in the second-stage polymerization step, and the polymerization initiator added before the first-stage polymerization step is involved in both the first-stage polymerization step and the second-stage polymerization step.

In the present invention, the aqueous dispersion medium means a medium which mainly consists of water.

In the present invention, the aqueous dispersion medium preferably contains a dispersion stabilizer. As the dispersion stabilizer, for example, there may be mentioned the following compounds: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II)hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Of the above dispersion stabilizers, preferred are inorganic compounds, and particularly preferred are colloids of hardly water-soluble metal hydroxides. By using such colloids, the particle size distribution of the colored resin particles can be adjusted to be narrow and, after washing, the amount of dispersion stabilizer residues can be decreased. Therefore, the toner thus obtained can sharply reproduce an image and shows excellent environmental stability.

1-3. The Polymerization Step

The production method of the present invention has at least the first-stage polymerization step and the second-stage polymerization step as the polymerization steps. Hereinafter, these two steps and the third-stage polymerization step, which preferably follows the two steps, will be described in order.

1-3-1. The First-Stage Polymerization Step

In the present invention, the first-stage polymerization step is a step of carrying out suspension polymerization by using the suspension containing at least the first-stage polymerizable monomer and the colorant, in the presence of the polymerization initiator.

The suspension polymerization is mainly initiated by heating the first-stage polymerizable monomer composition. The heating temperature (polymerization temperature) of the first-stage polymerizable monomer composition is preferably 50° C. or more, still more preferably 60 to 95° C.

As shown by the below-described formula (1), the first-stage polymerizable monomer is defined by $Tg_1$, which is the glass transition temperature of the polymer polymerized from the first-stage polymerizable monomer.

It is known that additivity at the absolute temperature holds in the glass transition temperature (hereinafter may be referred to as Tg) of a polymer. Accordingly, when two or more kinds of monomers are used as the first-stage polymerizable monomer, calculation Tg can be calculated by the following formulae (I) and (II):

$$\text{Calculation } Tg(K)=(M_A+M_B+M_C+\ldots)/[(M_A/Tg_A)+(M_B/Tg_B)+(M_C/Tg_C+\ldots] \quad \text{Formula (I):}$$

$$\text{Calculation } Tg(^\circ\text{C.})=\text{Calculation } Tg(K)-273 \quad \text{Formula (II):}$$

In the formula (1), $M_A$, $M_B$, $M_C$, . . . mean the amounts (parts by mass) of the monomers added, and $Tg_A$, $Tg_B$, $Tg_C$, . . . mean the glass transition temperatures (K) of the homopolymers of the monomers.

For example, when 75 parts by mass of styrene (Tg of the homopolymer=100°) and 15 parts by mass of n-butyl acrylate (Tg of the homopolymer=−55° C.) are used as the first-stage polymerizable monomer, $Tg_1$ of the polymer polymerized from the monomers is as follows:

$$\begin{aligned} Tg_1 &= [75(\text{parts by mass})+15(\text{parts by mass})]/ \\ &\quad [\{75(\text{parts by mass})/(100+273(\text{K}))\}+ \\ &\quad \{15(\text{parts by mass})/(-55+273(\text{K}))\}] \\ &= 90/(0.201+0.0688) \\ &= 333.5(\text{K}) \\ &= 60.5(^\circ\text{C}) \end{aligned}$$

Such a calculation of the glass transition temperature can be also performed similarly on $Tg_2$, which is the glass transition temperature of the polymer polymerized from the second-stage polymerizable monomer, $Tg_{1+2}$, which is the glass transition temperature of the polymer polymerized from the first-stage and second-stage polymerizable monomers, and $Tg_2$, which is the glass transition temperature of the polymer polymerized from the third-stage polymerizable monomer.

1-3-2. The Second-Stage Polymerization Step

In the present invention, the second-stage polymerization step is a step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is the glass transition temperature (° C.) of the polymer polymerized from the first-stage polymerizable monomer, and $Tg_2$ is the glass transition temperature (° C.) of the polymer polymerized from the second-stage polymerizable monomer.

In the present invention, the second-stage polymerizable monomer means a polymerizable monomer which is one of the polymerizable monomers used in the present invention and is used from the second-stage polymerization step for suspension polymerization.

At the level of the conventional technology, a toner in which a polymer having a low glass transition temperature is disposed on the outer side, is predicted to decrease its heat-resistant storage stability.

However, contrary to such a conventional prediction, the inventors of the present invention have found that better low-temperature fixability than ever can be obtained by covering the polymer polymerized in the first-stage polymerization step with a polymer having a lower glass transition temperature than the polymer, and the inventors have accomplished the method for producing a polymerized toner by multi-stage polymerization.

It is not clear yet why low-temperature fixability is improved by adding later a monomer which constitutes a polymer having a lower glass transition temperature.

However, for example, in the case of using a mixture of styrene and n-butyl acrylate as the first-stage polymerizable monomer, it is presumed as follows: since the n-butyl acrylate is polymerized first due to its high reactivity and much of the styrene remains at the final stage of polymerization, the amount of the styrene monomer unit on the outermost surface of the polymer particles is higher than that of the center of the particles. In such a polymer, it is predicted that the glass transition temperature of the outermost surface is higher than the center and lead to a deterioration in low-temperature fixability.

On the other hand, for example, in the case of adding n-butyl acrylate further as the second-stage polymerizable monomer when the polymerization conversion rate of the first-stage polymerization step is 20 to 80%, relatively much of the n-butyl acrylate remains even at the final stage of polymerization; therefore, it is expected that the distribution of the styrene monomer unit in the polymer thus obtained is more uniform compared to the case where the second-stage polymerization step is not carried out. The distribution of glass transition temperature in such a polymer is more uniform compared to the case where the second-stage polymerization is not carried out; therefore, it is thought that low-temperature fixability is improved.

As the second-stage polymerizable monomer, the first-stage polymerizable monomers can be used, within the range of the condition of the glass transition temperature defined by the above formula (1). For example, when 75 parts by mass of styrene and 15 parts by mass of n-butyl acrylate are used as the first-stage polymerizable monomers, there may be used the second-stage polymerizable monomer which constitutes a polymer having a glass transition temperature lower than 60.5° C.

As the first-stage polymerizable monomer, at least any one of styrene and styrene derivatives, which have relatively high glass transition temperatures, can be used. As the second-stage polymerizable monomer, at least any one of acrylic esters and methacrylic esters, which have relatively low glass transition temperatures, can be used.

Also in the present invention, a polymerizable monomer that the homopolymer has a glass transition temperature of 100° C. or more, which serves as the first-stage polymerizable monomer, can be used in combination with a polymerizable monomer that the homopolymer has a glass transition temperature of 10° C. or less, which serves as the second-stage polymerizable monomer. As the polymerizable monomer that the homopolymer has a glass transition temperature of 100° C. or more, there may be mentioned styrene (Tg of the homopolymer=100° C.), methyl methacrylate (Tg of the homopolymer=105° C.), acrylonitrile (Tg of the homopolymer=125° C.), methacrylonitrile (Tg of the homopolymer=120° C.), etc. As the polymerizable monomer that the homopolymer has a glass transition temperature of 10° C. or less, there may be mentioned 2-ethylhexyl acrylate (Tg of the homopolymer=−70° C.), n-butyl acrylate (Tg of the homopolymer=−55° C.), ethyl acrylate (Tg of the homopolymer=−24° C.), methyl acrylate (Tg of the homopolymer=10° C.), etc. A part of the polymerizable monomer that the homopolymer has a glass transition temperature of 10° C. or less, can be used as the first-stage polymerizable monomer in combination with the polymerizable monomer that the homopolymer has a glass transition temperature of 100° C. or more.

Examples of combinations of the first-stage polymerizable monomer and the second-stage polymerizable monomer include: a combination of styrene as the first-stage polymerizable monomer and n-butyl acrylate as the second-stage polymerizable monomer; a combination of styrene as the first-stage polymerizable monomer and 2-ethylhexyl acrylate as the second-stage polymerizable monomer; a combination of styrene and n-butyl acrylate as the first-stage polymerizable monomer and n-butyl acrylate as the second-stage polymerizable monomer; and a combination of styrene and 2-ethylhexyl acrylate as the first-stage polymerizable monomer and 2-ethylhexyl acrylate as the second-stage polymerizable monomer.

Of them, particularly preferred are the combination of styrene as the first-stage polymerizable monomer and n-butyl acrylate as the second-stage polymerizable monomer, and the combination of styrene and n-butyl acrylate as the first-stage polymerizable monomer and n-butyl acrylate as the second-stage polymerizable monomer.

This step is initiated when the polymerization conversion rate in the first-stage polymerization step becomes 20 to 80%. In the case where the first-stage polymerization step is initiated when the polymerization conversion rate is less than 20%, the second-stage polymerization step is initiated although the first-stage polymerization step is not sufficiently promoted yet. Therefore, as shown in the below-described Comparative Example 2, the toner thus obtained is poor in low-temperature fixability. On the other hand, in the case where the first-stage polymerization step is initiated after the polymerization conversion rate exceeds 80%, the initiation of the second-stage polymerization step is too late. Therefore, the glass transition temperature of the polymer present on the toner surface becomes too low. As a result, as shown in the below-described Comparative Example 3, the toner thus obtained is poor in heat-resistant storage stability.

It is preferable that the second-stage polymerization step is initiated when the polymerization conversion rate in the first-stage polymerization step becomes 30 to 75%. It is more preferable that the second-stage polymerization step is initiated when the polymerization conversion rate is 35 to 65%. It is still more preferable that the second-stage polymerization step is initiated when the polymerization conversion rate is 45 to 60%.

It is preferable that in the formula (1), $Tg_1$ is 5° C. to 250° C. higher than $Tg_2$. When the difference between $Tg_1$ and $Tg_2$ is less than 5° C., the difference in glass transition temperature between the polymer polymerized by the first-stage polymerization step and the polymer polymerized by the second-stage polymerization step, is not sufficient. Therefore, the toner thus obtained may be poor in low-temperature fixability. On the other hand, when the difference between $Tg_1$ and $Tg_2$ exceeds 250° C., the glass transition temperature of the toner particle surface is increased and may result in poor low-temperature fixability.

In the formula (1), $Tg_1$ is preferably 50 to 200° C. higher than $Tg_2$, more preferably 100 to 160° C. higher than $Tg_2$.

The mass ratio of the first-stage polymerizable monomer to the second-stage polymerizable monomer is preferably the first-stage polymerizable monomer:the second-stage polymerizable monomer=60:40 to 95:5, more preferably 65:35 to 75:25. When the ratio of the first-stage polymerizable monomer used is too much higher than the above, the colored resin particles thus obtained become too hard and may result in poor low-temperature fixability. When the ratio of the second-stage polymerizable monomer used is too much higher than the above, the colored resin particles thus obtained become too soft and may result in poor heat-resistant storage stability.

The ratio of use of the first-stage polymerizable monomer to the second-stage polymerizable monomer is substantially the same as the ratio of the monomer units in the thus-obtained polymer.

In the second-stage polymerization step, the above-described polymerization initiator can be added as needed.

However, polymerization can be kept by using the polymerization initiator added in the first-stage polymerization step as it is, without adding a new polymerization initiator in the second-stage polymerization step.

In the second-stage polymerization step, the polymerization temperature is preferably 50° C. or more, more preferably 60 to 95° C., as with the polymerization temperature in the first-stage polymerization step.

1-3-3. The Third-Stage Polymerization Step

In the present invention, after the second-stage polymerization step, it is preferable to carry out the third-stage polymerization step further. The third-stage polymerization step is a step of carrying out suspension polymerization by further adding a polymerization initiator and a third-stage polymerizable monomer satisfying the following formula (2), when a polymerization conversion rate until the second-stage polymerization step becomes 95% or more:

$$Tg_{1+2} < Tg_3 \qquad \text{Formula (2):}$$

wherein $Tg_{1+2}$ is the glass transition temperature (° C.) of the polymer polymerized from the first-stage and second-stage polymerizable monomers, and $Tg_3$ is the glass transition temperature (° C.) of the polymer polymerized from the third-stage polymerizable monomer.

In preferable embodiments of the present invention, the third-stage polymerizable monomer means a polymerizable monomer which is one of the polymerizable monomers used in the present invention and is used from the third-stage polymerization step for suspension polymerization.

By carrying out the third-stage polymerization step, the outside of the colored resin particles formed until the second-stage polymerization step can be covered with the polymer having the glass transition temperature $Tg_3$ that is higher than the glass transition temperature $Tg_{1+2}$ of the colored resin particles. As just described, by covering the colored resin particles with a material having a higher glass transition temperature, a balance between low-temperature fixability and heat-resistant storage stability can be achieved.

The glass transition temperature $Tg_{1+2}$ of the polymer polymerized from the first-stage and second-stage polymerizable monomers, represents the average glass transition temperature of the colored resin particles obtained by polymerization until the second-stage polymerization step. $Tg_{1+2}$ can be calculated by using the above-described additivity of the glass transition temperature of the polymer. For example, when 75 parts by mass of styrene and 15 parts by mass of n-butyl acrylate are used as the first-stage polymerizable monomers and 10 parts by mass of n-butyl acrylate is used as the second-stage polymerizable monomer, $Tg_{1+2}$ of the polymer polymerized from these monomers is as follows:

$$\begin{aligned} Tg_{1+2} &= [75(\text{parts by mass}) + 25(\text{parts by mass})] / \\ &\quad [\{75(\text{parts by mass})/(100 + 273(\text{K}))\} + \\ &\quad \{25(\text{parts by mass})/(-55 + 273(\text{K}))\}] \\ &= 100/(0.201 + 0.115) \\ &= 317\,(\text{K}) \\ &= 44(^\circ\,\text{C}) \end{aligned}$$

Accordingly, when 75 parts by mass of styrene and 15 parts by mass of n-butyl acrylate are used as the first-stage polymerizable monomers and 10 parts by mass of n-butyl acrylate is used as the second-stage polymerizable monomer, it is preferable to use the third-stage polymerizable monomer which constitutes a polymer having a glass transition temperature higher than 44° C.

This step is initiated when the polymerization conversion rate until the second-stage polymerization step becomes 95% or more. In the case where the third-stage polymerization step is initiated when the polymerization conversion rate is less than 95%, the third-stage polymerization step is initiated although the second-stage polymerization step is not sufficiently promoted yet. Therefore, much of the second-stage polymerizable monomer is spent in the third-stage polymerization step. As a result, the glass transition temperature of the polymer present on the toner surface becomes too low, so that the toner thus obtained is poor in heat-resistant storage stability.

It is preferable that the third-stage polymerization step is initiated when the polymerization conversion rate until the second-stage polymerization step becomes 96% or more. It is more preferable that the third-stage polymerization step is initiated when the polymerization conversion rate is 98% or more.

It is preferable that in the formula (2), $Tg_3$ is 10° C. to 100° C. higher than $Tg_{1+2}$. When the difference between $Tg_3$ and $Tg_{1+2}$ is less than 10° C., the difference in glass transition temperature between the polymer polymerized in and before the second-stage polymerization step and the polymer polymerized by the third-stage polymerization step, is not sufficient. Therefore, the toner thus obtained may be poor in heat-resistant storage stability. On the other hand, when the difference between $Tg_3$ and $Tg_{1+2}$ exceeds 100° C., the difference in glass transition temperature between the polymer polymerized in and before the second-stage polymerization step and the polymer polymerized by the third-stage polymerization step is too large, so that the toner thus obtained may be poor in low-temperature fixability.

In the formula (2), $Tg_3$ is preferably 30 to 90° C. higher than $Tg_{1+2}$, more preferably 50 to 75° C. higher than $Tg_{1+2}$.

As the third-stage polymerizable monomer, the first-stage polymerizable monomers and second-stage polymerizable monomers can be used, within the range of the condition of the glass transition temperature defined by the formula (2). Of them, it is preferable to use monomers which can provide a polymer having a Tg of more than 80° C., such as styrene, acrylonitrile and methyl methacrylate, alone or in combination of two or more kinds.

As the polymerization initiator that is used for polymerization of the third-stage polymerizable monomer, for example, there may be mentioned water-soluble polymerization initiators including metal persulfates such as potassium persulfate and ammonium persulfate; and azo-based initiators such as 2,2'-azobis(2-methyl-N-(2-hydroxyethyl) propionamide) and 2,2'-azobis(2-methyl-N-(1,1-bis(hydroxymethyl)2-hydroxyethyl)propionamide). They can be used alone or in combination of two or more kinds. The polymerization initiator is preferably used in an amount of 0.1 to 30 parts by mass, more preferably 1 to 20 parts by mass, relative to 100 parts by mass of the third-stage polymerizable monomer.

In the third-stage polymerization step, the polymerization temperature is preferably 50° C. or more, more preferably 60 to 95° C. The polymerization reaction time is preferably 1 to 20 hours, more preferably 2 to 15 hours.

1-4. The Washing, Filtering, Dehydrating and Drying Steps

After the polymerization is completed, the aqueous dispersion of the colored resin particles obtained by the polymerization are preferably subjected to repeated cycles of filtering, washing (for removal of the dispersion stabilizer), dehydrating and drying, as needed, according to a known method.

Washing is preferably carried out by the following method: in the case of using an inorganic compound as the dispersion stabilizer, by adding an acid or alkali to the aqueous dispersion, the dispersion stabilizer is dissolved in water and then removed. In the case of using a colloid of a hardly water-soluble inorganic hydroxide as the dispersion stabilizer, it is preferable to add an acid to adjust the pH of the aqueous dispersion to pH 6.5 or less. As the acid added, there may be used inorganic acids such as sulfuric acid, hydrochloric acid and nitric acid, and organic acids such as formic acid and acetic acid. Sulfuric acid is particularly preferred, because of large removal efficiency and small pressure on production facilities.

Dehydrating and filtering can be carried out by various kinds of known methods, and the methods are not particularly limited. For example, there may be mentioned a centrifugal filtration method, a vacuum filtration method, a pressure filtration method, etc. Drying can be also carried out by various kinds of methods, and the methods are not particularly limited.

2. The Colored Resin Particles

The colored resin particles are obtained by the above-mentioned suspension polymerization method. Hereinafter, the colored resin particles that constitute the toner will be described.

The colored resin particles preferably have a volume average particle diameter (Dv) of 4 to 12 μm, more preferably 5 to 10 μm. When the Dv is less than 4 μm, toner flowability is decreased and may result in poor transferability or decrease in image density. When the Dv is more than 12 μm, image resolution may be decreased.

As for the colored resin particles, the ratio (Dv/Dn) of the volume average particle diameter (Dv) to the number average particle diameter (Dn) is preferably 1.0 to 1.3, more preferably 1.0 to 1.2. When the Dv/Dn is more than 1.3, there may be a decrease in transferability, image density and resolution. The volume and number average particle diameters of the colored resin particles can be measured by a particle size analyzer (product name: Multisizer; manufactured by: Beckman Coulter, Inc.), for example.

In the present invention, from the viewpoint of image reproducibility, the colored resin particles preferably have an average circularity of 0.96 to 1.00, more preferably 0.97 to 1.00, still more preferably 0.98 to 1.00.

When the colored resin particles have an average circularity of less than 0.96, thin line reproducibility may be deteriorated.

In the present invention, "circularity" is defined as a value which is obtained by dividing the perimeter of a circle having the same area as the projected area of a particle image by the perimeter of the projected particle image. Also in the present invention, "average circularity" is used as a simple method for quantitatively describing the form of the particles and is an indicator that shows the degree of the surface roughness of the colored resin particles. The average circularity is 1 when the colored resin particles are perfectly spherical, and it gets smaller as the surface shape of the colored resin particles becomes more complex.

3. The Method for Producing a Polymerized Toner

In the present invention, preferably, an external additive is attached to the surface of the colored resin particles by mixing the colored resin particles with the external additive and agitating them, thus obtaining a one-component toner (developer). The one-component toner can be further mixed with carrier particles and agitated to obtain a two-component developer.

The agitator used for the attachment is not particularly limited, as long as it is an agitator that is able to attach the external additive to the surface of the colored resin particles. The attachment can be carried out by an agitator that is capable of mixing and agitating, such as FM Mixer (product name; manufactured by: Nippon Coke & Engineering Co., Ltd.), Super Mixer (product name; manufactured by: Kawata Mfg. Co., Ltd.), Q Mixer (product name; manufactured by: Nippon Coke & Engineering Co., Ltd.), Mechanofusion system (product name; manufactured by: Hosokawa Micron Corporation) or Mechanomill (product name; manufactured by: Okada Seiko Co., Ltd.)

As the external additive, there may be mentioned inorganic fine particles of silica, titanium oxide, aluminum oxide, zinc oxide, tin oxide, calcium carbonate, calcium phosphate, cerium oxide and so on, and organic particles of polymethyl methacrylate resin, silicone resin, melamine resin and so on. Of them, preferred are inorganic fine particles. Of inorganic fine particles, preferred are inorganic fine particles of silica and titanium oxide, and particularly preferred are inorganic fine particles of silica.

These external additives can be used alone or in combination of two or more kinds. It is particularly preferable to use two or more kinds of silica particles having different particle diameters.

In the present invention, the external additive is generally used in an amount of 0.05 to 6 parts by mass, preferably 0.2 to 5 parts by mass, relative to 100 parts by mass of the colored resin particles. When the amount of the external additive added is less than 0.05 part by mass, toner transferability may lower. When the amount of the external additive added is more than 6 parts by mass, fog may be produced.

4. The Toner of the Present Invention

The toner of the present invention is a toner having an excellent balance between heat-resistant storage stability and low-temperature fixability.

As an indicator of heat-resistant storage stability, for example, there may be mentioned a heatproof temperature determined by the following method.

A predetermined amount of toner is put in a container. The container is hermetically closed and then left under a predetermined temperature condition. After the passage of a predetermined time, the toner is removed from the container onto a screen and set in a powder measuring device (product name: Powder Tester PT-X; manufactured by: Hosokawa Micron Corporation), for example. The screen is vibrated under a predetermined amplitude condition for a predetermined time. Then, the mass of the toner remaining on the screen is measured and used as the mass of the aggregated toner. The maximum temperature at which the mass of the aggregated toner is equal to or less than a predetermined threshold mass, is determined as the heatproof temperature of the toner.

As an indicator of low-temperature fixability, for example, there may be mentioned a minimum fixing temperature determined by the following method.

The toner fixing rate at a predetermined temperature is measured by using a predetermined printer. A black solid area is printed on a test paper by the printer. The toner fixing rate is calculated from the ratio of image densities of the black solid area before and after being subjected to a predetermined tape removal operation. More specifically, when the image density before the tape removal is referred to as "ID (before)" and the image density after the tape removal is referred to as "ID (after)", the toner fixing rate can be calculated by the following formula. The image densities are measured with a reflection image densitometer (product name: RD918; manufactured by: McBeth), for example.

$$\text{Fixing rate (\%)}=(\text{ID(after)}/\text{ID(before)})\times 100$$

In this fixing test, the fixing temperature at which the toner fixing rate is equal to or more than a predetermined threshold value, is determined as the minimum fixing temperature of the toner.

The heatproof temperature is preferably 55° C. or more. When the heatproof temperature is less than 55° C., blocking is likely to occur when applied to heat, and quality may not be guaranteed after transfer. Even if the heatproof temperature is high and the heat-resistant storage stability is much excellent, when the minimum fixing temperature is too high, a large amount of energy is required when fixed with an image forming device, so that it is not eco-friendly.

EXAMPLES

Hereinafter, the present invention will be described in more detail, by way of examples and comparative examples. However, the present invention is not limited to the examples. All designations of part(s) and % are expressed on mass basis, unless otherwise noted.

Test methods carried out in Examples and Comparative Examples are as follows.

1. Toner Production

Example 1

The following raw materials were subjected to wet pulverization, using a media type wet pulverizer, thereby obtaining a mixture: as the first-stage polymerizable monomers, 75 parts of styrene and 15 parts of n-butyl acrylate, which are monovinyl monomers; as a macromonomer, 0.25 part of polymethacrylic acid ester macromonomer (product name: AA6; manufactured by: TOAGOSEI Co., Ltd., Tg=94° C.); and as a black colorant, 7 parts of carbon black (product name: #25B; manufactured by: Mitsubishi Chemical Corporation). To the mixture, the following raw materials were added and dissolved, thereby obtaining the first-stage polymerizable monomer composition: as a charge control agent, 0.5 part of a charge control resin (product name: Acrybase FCA-161P; manufactured by: Fujikura Kasei Co., Ltd.); as a release agent, 2 parts of hexaglycerin octabehenate (acid value: 0.5 mgKOH/g, hydroxyl group value: 0.5 mgKOH/g) and 4 parts of paraffin wax (product name: HNP-11; manufactured by: Nippon Seiro Co., Ltd.); and as a molecular weight modifier, 1.0 part of tetraethylthiuram disulfide (product name: Nocceler TET-G; manufactured by: Ouchi Shinko Chemical Industrial Co., Ltd.)

An aqueous solution of 7.0 parts of sodium hydroxide dissolved in 50 parts of ion-exchange water was gradually added, with agitation, to an aqueous solution of 10.0 parts of magnesium chloride dissolved in 200 parts of ion-exchange water, thus preparing a magnesium hydroxide colloid dispersion.

To the magnesium hydroxide colloid dispersion obtained above, the first-stage polymerizable monomer composition was added and further agitated. As a polymerization initiator, 4.4 parts of t-butylperoxy-2-ethylbutanoate (product name: Trigonox 27; manufactured by: Kayaku Akzo Corporation) was added thereto. To the dispersion in which the polymerization initiator was added, 0.7 part of divinylbenzene was added as a cross-linking agent. Then, the dispersion was subjected to high shear agitation with an in-line emulsification device (product name: CAVITRON; manufactured by: Pacific Machinery & Engineering Co., Ltd.) at a rotational frequency of 15,000 rpm for one minute, thus forming droplets of the first-stage polymerizable monomer composition (the suspension step).

The glass transition temperature $Tg_1$ of the polymer polymerized from the first-stage polymerizable monomer is 60.5° C.

The dispersion having the droplets formed therein was put in a reactor. The reactor temperature was increased to 90° C. to initiate polymerization reaction (the first-stage polymerization step). When the polymerization conversion rate reached 60%, 10 parts of n-butyl acrylate was added thereto as the second-stage polymerizable monomer, and reaction was carried out at 90° C. for hours (the second-stage polymerization step). The glass transition temperature $Tg_2$ of the polymer polymerized from the second-stage polymerizable monomer is −55° C. Therefore, $Tg_1$ is 116° C. higher than $Tg_2$.

Then, when the polymerization conversion rate reached 99.8%, the following raw materials were added thereto: as the third-stage polymerizable monomer, 3.0 parts of methyl methacrylate, and as a polymerization initiator, 0.3 part of 2,2'-azobis-(2-methyl-N-(1,1-bis(hydroxymethyl)2-hydroxyethyl)propionamide) (product name: VA-086; manufactured by Wako Pure Chemical Industries, Ltd.) dissolved in 30 parts of ion-exchange water. The reaction was kept at 90° C. for 3 hours (the third-stage polymerization step) and then stopped, thus obtaining an aqueous dispersion of core-shell colored resin particles.

The glass transition temperature $Tg_{1+2}$ of the polymer polymerized from the first-stage and second-stage polymerizable monomers, is 43.7° C. The glass transition temperature $Tg_3$ of the polymer polymerized from the third-stage polymerizable monomer is 105° C. Therefore, $Tg_3$ is 61.3° C. higher than $Tg_{1+2}$.

Acid washing was carried out on the above-obtained aqueous dispersion of the colored resin particles, by adding sulfuric acid thereto in a dropwise manner, with agitation at room temperature, until the pH of the aqueous dispersion was set to 6.5 or less. Then, filtration separation was carried out thereon, followed by addition of 500 parts of ion-exchange water to turn the thus-obtained solid into a slurry again. Water washing treatment (washing, filtering and dehydrating) was carried out on the slurry repeatedly several times. Next, filtration separation was carried out thereon, and the thus-obtained solid was put in the container of a drier and dried at 40° C. for 48 hours, thus obtaining colored resin particles having a volume average particle diameter (Dv) of 6.79 μm, a particle size distribution (Dv/Dn) of 1.12, and an average circularity of 0.987.

To 100 parts of the dried colored resin particles, 1 part of fine silica particles hydrophobized with cyclic silazane (number average primary particle diameter: 7 nm) and 1 part of fine silica particles hydrophobized with amino-modified silicone oil (number average primary particle diameter: 35 nm) were added and mixed with a high-speed agitator (product name: FM Mixer; manufactured by: Nippon Coke & Engineering Co., Ltd.), thus producing the polymerized toner of Example 1 (non-magnetic one-component toner for developing electrostatic images). The test results are shown in Table 1.

Example 2

The polymerized toner of Example 2 was produced in the same manner as Example 1, except the following: at the time of preparing the magnesium hydroxide colloid dispersion, 10.0 parts of magnesium chloride was changed to 9.6 parts, and 7.0 parts of sodium hydroxide was changed to 6.7 parts; 75 parts of styrene and 5 parts of n-butyl acrylate were used as the first-stage polymerizable monomers, in place of using 75 parts of styrene and 15 parts of n-butyl acrylate; 20 parts of n-butyl acrylate was used as the second-stage polymerizable monomer, in place of using 10 parts of n-butyl acrylate; and the time of initiation of the second-stage polymerization step was changed to the time when the polymerization conversion rate of the first-stage polymerization step reached 55%. In Example 2, the glass transition temperature $Tg_1$ of the polymer polymerized from the first-stage polymerizable monomer is 80.0° C., and the glass transition temperature $Tg_2$ of the polymer polymerized from the second-stage polymerizable monomer is −55° C. Therefore, $Tg_1$ is 135° C. higher than $Tg_2$. Test results are shown in Table 1.

Example 3

The polymerized toner of Example 3 was produced in the same manner as Example 1, except the following: at the time of preparing the magnesium hydroxide colloid dispersion, 10.0 parts of magnesium chloride was changed to 9.4 parts, and 7.0 parts of sodium hydroxide was changed to 6.6 parts; 75 parts of styrene was used as the first-stage polymerizable monomer, in place of using 75 parts of styrene and 15 parts of n-butyl acrylate; 25 parts of n-butyl acrylate was used as the second-stage polymerizable monomer, in place of using 10 parts of n-butyl acrylate; and the time of initiation of the second-stage polymerization step was changed to the time when the polymerization conversion rate of the first-stage polymerization step reached 58%. In Example 3, the glass transition temperature $Tg_1$ of the polymer polymerized from the first-stage polymerizable monomer is 100° C., and the glass transition temperature $Tg_2$ of the polymer polymerized from the second-stage polymerizable monomer is −55° C. Therefore, $Tg_1$ is 155° C. higher than $Tg_2$. Test results are shown in Table 1.

Example 4

The polymerized toner of Example 4 was produced in the same manner as Example 2, except that the time of initiation of the second-stage polymerization step was changed to the time when the polymerization conversion rate of the first-stage polymerization step reached 41%. The test results are shown in Table 1.

Example 5

The polymerized toner of Example 5 was produced in the same manner as Example 2, except that the time of initiation of the second-stage polymerization step was changed to the time when the polymerization conversion rate of the first-stage polymerization step reached 71%. Test results are shown in Table 1.

Example 6

The polymerized toner of Example 6 was produced in the same manner as Example 1, except the following: at the time of preparing the magnesium hydroxide colloid dispersion, 10.0 parts of magnesium chloride was changed to 9.6 parts, and 7.0 parts of sodium hydroxide was changed to 6.7 parts; 79 parts of styrene and 1 part of 2-ethylhexyl acrylate were used as the first-stage polymerizable monomers, in place of using 75 parts of styrene and 15 parts of n-butyl acrylate; 20 parts of 2-ethylhexyl acrylate was used as the second-stage polymerizable monomer, in place of using 10 parts of n-butyl acrylate; the time of initiation of the second-stage polymerization step was changed to the time when the polymerization conversion rate of the first-stage polymerization step reached 52%; and the time of initiation of the third-stage polymerization step was changed to the time when the polymerization conversion rate of the second-stage polymerization step reached 99.5%. In Example 6, the glass transition temperature $Tg_1$ of the polymer polymerized from the first-stage polymerizable monomer is 96.1° C., and the glass transition temperature $Tg_2$ of the polymer polymerized from the second-stage polymerizable monomer is −70° C. Therefore, $Tg_1$ is 166° C. higher than $Tg_2$. The glass transition temperature $Tg_{1+2}$ of the polymer polymerized from the first-stage and second-stage polymerizable monomers is 44.2° C., and the glass transition temperature $Tg_3$ of the polymer polymerized from the third-stage polymerizable monomer is 105° C. Therefore, $Tg_3$ is 60.8° C. higher than $Tg_{1+2}$. Test results are shown in Table 1.

Comparative Example 1

Polymerization was carried out in the same manner as Example 1, except the following: at the time of preparing the magnesium hydroxide colloid dispersion, 10.0 parts of magnesium chloride was changed to 10.4 parts, and 7.0 parts of sodium hydroxide was changed to 7.3 parts; in the first-stage polymerization step, polymerization was carried out by using 75 parts of styrene and 25 parts of n-butyl acrylate as the first-stage polymerizable monomers, in place of using 75 parts of styrene and 15 parts of n-butyl acrylate; and the second-stage polymerization step was not carried out. Then, reaction was carried out at 90° C. for 4 hours. When the polymerization conversion rate reached 99.8%, the third-stage polymerization step and subsequent steps were carried out in the same manner as Example 1, thus producing the polymerized toner of Comparative Example 1. That is, the second-stage polymerization step carried out in Example 1 was not carried out in Comparative Example 1. Test results are shown in Table 1.

Comparative Example 2

The polymerized toner of Comparative Example 2 was produced in the same manner as Example 2, except that the time of initiation of the second-stage polymerization step was changed to the time when the polymerization conversion rate of the first-stage polymerization step reached 10%. Test results are shown in Table 1.

Comparative Example 3

The polymerized toner of Comparative Example 3 was produced in the same manner as Example 2, except that the time of initiation of the second-stage polymerization step was changed to the time when the polymerization conversion rate of the first-stage polymerization step reached 90%. Test results are shown in Table 1.

2. Evaluation of Polymerized Toners

The polymerized toners of Examples 1 to 6 and Comparative Examples 1 to 3 were evaluated for colored resin particle characteristics, toner characteristics and printing characteristics. Details are as follows.

2-1. Colored Resin Particle Characteristics and Toner Characteristics (a) Volume Average Particle Diameter (Dv), Number Average Particle Diameter (Dn) and Particle Size Distribution (Dv/Dn) of Colored Resin Particles Approximately 0.1 g of the measurement sample (colored resin particles) was put in a beaker. An alkylbenzene sulfonic acid aqueous solution (product name: Driwel; manufactured by: Fujifilm Corporation) of 0.1 mL was added thereto, which serves as a dispersant. In addition, 10 to 30 mL of Isoton II was put in the beaker. The mixture was dispersed for 3 minutes with a 20 W (watt) ultrasonic disperser. Then, the volume average particle diameter (Dv) and number average particle diameter (Dn) of the colored resin particles were measured with a particle diameter measuring device (product name: Multisizer; manufactured by: Beckman Coulter, Inc.) in the following condition, followed by calculation of the particle size distribution (Dv/Dn).

Aperture diameter: 100 μm

Medium: Isoton II

Number of measured particles: 100,000 particles (b) Average Circularity of Colored Resin Particles First, 10 mL of ion-exchange water was put in a container. Then, 0.02 g of a surfactant (alkylbenzene sulfonic acid) was added thereto, which serves as a dispersant. In addition, 0.02 g of the measurement sample (colored resin particles) was added thereto. The mixture was subjected to dispersion treatment for 3 minutes with an ultrasonic disperser at 60 W (watt). The resultant was adjusted so as to have a colored resin particle concentration of 3,000 to 10,000 particles/μL at the time of measurement. Of the colored resin particles, 1,000 to 10,000 particles of 0.4 μm or more by a diameter of the equivalent circle were measured with a flow particle image analyzer (product name: FPIA-2100; manufactured by: Sysmex Corporation). The average circularity was obtained from the measured values.

The circularity is expressed by the following calculation formula 1. The average circularity is the average of circularities measured by the calculation formula 1.

(Circularity)=(The perimeter of a circle having the same area as the projected area of a particle image)/(The perimeter of a particle image) Calculation Formula 1:

(c) Heatproof Temperature of Toners

First, 20 g of each toner was put in a 100-mL polyethylene container. The container was capped and hermetically sealed with a lid so that no water enters the container. The container was then immersed in water in a constant temperature water bath (product name: BK300; manufactured by: Yamato Scientific Co., Ltd.) at a predetermined temperature for 8 hours, and then removed from the bath. The toner was removed from the container onto a 42-mesh screen (pore diameter 355 μm), keeping the toner away from vibration as much as possible, and then set in a powder measuring device (product name: Powder Tester PT-X; manufactured by Hosokawa Micron Corporation). The screen was vibrated at an amplitude of 1.0 mm for 30 seconds. The mass of the toner remaining on the screen was measured and used as the mass of the aggregated toner. The maximum temperature at which the mass of the aggregated toner is 5% or less of the mass of the original toner, was used as the heatproof temperature to evaluate heat-resistant storage stability.

2-2. Printing Characteristics (a) Measurement of Fixing Temperature

A fixing test was carried out by using a commercially-available, non-magnetic one-component development printer (printing rate=20 sheets/min) which had been modified to be able to change the temperature of the fixing roller. In the fixing test, the temperature of the fixing roller of the modified printer was changed by 5° C., and every time the temperature was changed, the toner fixing rate at each temperature was measured.

The toner fixing rate was calculated from the ratio of image densities of a black solid area, which was printed on a test sheet by the modified printer, before and after subjected to a tape removal operation. More specifically, when the image density before the tape removal is referred to as "ID (before)" and the image density after the tape removal is referred to as "ID (after)", the toner fixing rate can be calculated by the following formula:

$$\text{Fixing rate (\%)}=(\text{ID(after)}/\text{ID(before)})\times 100$$

In particular, the tape removal is an operation having the steps of: attaching a piece of adhesive tape (product name: Scotch Mending Tape 810-3-18; manufactured by: Sumitomo 3M Limited) to the measurement part (the black solid area) on the test sheet; firmly attaching the piece of the adhesive tape by pressing the piece at a given pressure; and then removing the piece of the adhesive tape at a constant speed in a direction along the sheet. Image density was measured with a reflection-type densitometer (product name: RD918; manufactured by: McBeth).

In this fixing test, the minimum fixing roller temperature at which the toner fixing rate is 80% or more, was referred to as the minimum fixing temperature of the toner.

The measurement and evaluation results of the polymerized toners of Examples 1 to 6 and Comparative Examples 1 to 3 are shown in Table 1.

In the following Table 1, "St" means styrene; "BA" means n-butyl acrylate; "2-EHA" means 2-ethylhexyl acrylate; and "MMA" means methyl methacrylate.

TABLE 1

| | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|
| First-stage | St (parts) | 75 | 75 | 75 | 75 | 75 | 79 | 75 | 75 | 75 |
| | BA (parts) | 15 | 5 | 0 | 5 | 5 | 0 | 25 | 5 | 5 |
| | 2-EHA (parts) | 0 | 0 | 0 | 0 | 0 | 1 | 0 | 0 | 0 |
| | $Tg_1$ (° C.) | 60.5 | 80.0 | 100 | 80.0 | 80.0 | 96.1 | 43.7 | 80.0 | 80.0 |
| Second-stage | Polymerization conversion rate (%) when added | 60 | 55 | 58 | 41 | 71 | 52 | — | 10 | 90 |
| | BA (parts) | 10 | 20 | 25 | 20 | 20 | 0 | — | 20 | 20 |

TABLE 1-continued

| | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|
| | 2-EHA (parts) | 0 | 0 | 0 | 0 | 0 | 20 | 0 | 0 | 0 |
| | $Tg_2$ (° C.) | −55 | −55 | −55 | −55 | −55 | −70 | — | −55 | −55 |
| | $Tg_{1+2}$ (° C.) | 43.7 | 43.7 | 43.7 | 43.7 | 43.7 | 44.2 | 43.7 | 43.7 | 43.7 |
| Third-stage | Polymerization conversion rate (%) when added | 99.8 | 99.8 | 99.8 | 99.8 | 99.8 | 99.5 | 99.8 | 99.8 | 99.8 |
| | MMA (parts) | 3.0 | 3.0 | 3.0 | 3.0 | 3.0 | 3.0 | 3.0 | 3.0 | 3.0 |
| | $Tg_3$ (° C.) | 105 | 105 | 105 | 105 | 105 | 105 | 105 | 105 | 105 |
| Toner | Volume average particle diameter Dv (μm) | 6.79 | 6.83 | 6.89 | 6.85 | 6.89 | 6.74 | 6.85 | 6.84 | 6.79 |
| | Particle size distribution (Dv/Dn) | 1.12 | 1.12 | 1.12 | 1.12 | 1.12 | 1.12 | 1.12 | 1.13 | 1.13 |
| | Average circularity | 0.98 | 0.98 | 0.98 | 0.98 | 0.98 | 0.98 | 0.98 | 0.98 | 0.98 |
| Evaluation | Heatproof temperature (° C.) | 56 | 56 | 55 | 56 | 55 | 55 | 56 | 56 | 51 |
| | Minimum fixing temperature (° C.) | 135 | 130 | 125 | 135 | 130 | 130 | 140 | 140 | 130 |

3. Conclusion of Toner Evaluation

Hereinafter, the evaluation results of the toners will be studied, with reference to Table 1.

According to Table 1, the polymerized toner of Comparative Example 1 is a toner that was produced without carrying out the second-stage polymerization step in the present invention. The heatproof temperature of the polymerized toner of Comparative Example 1 is as high as 56° C. Therefore, there is no problem with at least the heat-resistant storage stability of the polymerized toner of Comparative Example 1.

However, the minimum fixing temperature of the polymerized toner of Comparative Example 1 is as high as 140° C. Therefore, it is clear that the polymerized toner of Comparative Example 1, which was produced without carrying out the second-stage polymerization step in the present invention, has such a problem that it is poor in low-temperature fixability.

According to Table 1, the polymerized toner of Comparative Example 2 is a toner that was obtained by initiating the second-stage polymerization step when the polymerization conversion rate of the first-stage polymerization step reached 10%. The heatproof temperature of the polymerized toner of Comparative Example 2 is as high as 56° C. Therefore, there is no problem with at least the heat-resistant storage stability of the polymerized toner of Comparative Example 2.

However, the minimum fixing temperature of the polymerized toner of Comparative Example 2 is as high as 140° C. Therefore, the polymerized toner of Comparative Example 2, which was produced by initiating the second-stage polymerization step when the polymerization conversion rate of the first-stage polymerization step was too low, has such a problem that it is poor in low-temperature fixability.

According to Table 1, the polymerized toner of Comparative Example 3 is a toner that was obtained by initiating the second-stage polymerization step when the polymerization conversion rate of the first-stage polymerization step reached 90%. The minimum fixing temperature of the polymerized toner of Comparative Example 3 is as low as 130° C. Therefore, there is no problem with at least the low-temperature fixability of the polymerized toner of Comparative Example 3.

However, the heatproof temperature of the polymerized toner of Comparative Example 3 is as low as 51° C. Therefore, it is clear that the polymerized toner of Comparative Example 3, which was produced by initiating the second-stage polymerization step when the polymerization conversion rate of the first-stage polymerization step was high enough, has such a problem that it is poor in heat-resistant storage stability.

On the other hand, according to Table 1, the polymerized toners of Examples 1 to 6 are toners that were produced by further adding the second-stage polymerizable monomer, which constitutes the polymer having the glass transition temperature $Tg_2$ that is lower than the glass transition temperature $Tg_1$ of the polymer polymerized from the first-stage polymerizable monomer, when the polymerization conversion rate of the first-stage polymerization step was 20 to 80%.

According to Table 1, the heatproof temperatures of the polymerized toners of Examples 1 to 6 are all 55° C. or more, so that the polymerized toners have excellent heat-resistant storage stability. Also according to Table 1, the minimum fixing temperatures of the polymerized toners of Examples 1 to 6 are all 135° C. or less, so that the polymerized toners have excellent low-temperature fixability.

Therefore, it is clear that the polymerized toners of Examples 1 to 6, which were produced by the production method satisfying the above-mentioned conditions, can achieve an excellent balance between an increase in heat-resistant storage stability and an increase in low-temperature fixability, which traditionally have a trade-off relationship with each other.

The invention claimed is:

1. A method for producing a polymerized toner, wherein the method comprises:

a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer;

a first-stage polymerization step of carrying out suspension polymerization by using the suspension, in the presence of a polymerization initiator; and a second-stage polymerization step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is a glass transition temperature (° C.) of a polymer polymerized from the first-stage polymerizable monomer, and $Tg_2$ is a glass transition temperature (° C.) of a polymer polymerized from the second-stage polymerizable monomer.

2. The method for producing a polymerized toner according to claim 1, wherein a mass ratio of the first-stage polymerizable monomer to the second-stage polymerizable monomer is the first-stage polymerizable monomer:the second-stage polymerizable monomer=60:40 to 95:5.

3. The method for producing a polymerized toner according to claim 1, wherein, in the formula (1), $Tg_1$ is 5° C. to 250° C. higher than $Tg_2$.

4. A method for producing a polymerized toner, wherein the method comprises:

a suspension step of obtaining a suspension in which droplets of a first-stage polymerizable monomer composition containing at least a first-stage polymerizable monomer and a colorant are dispersed, by suspending the first-stage polymerizable monomer composition in an aqueous dispersion medium containing a dispersion stabilizer;

a first-stage polymerization step of carrying out suspension polymerization by using the suspension, in the presence of a polymerization initiator;

a second-stage polymerization step of carrying out suspension polymerization by further adding a second-stage polymerizable monomer satisfying the following formula (1), when a polymerization conversion rate in the first-stage polymerization step becomes 20 to 80%:

$$Tg_1 > Tg_2 \quad \text{Formula (1):}$$

wherein $Tg_1$ is a glass transition temperature (° C.) of a polymer polymerized from the first-stage polymerizable monomer, and $Tg_2$ is a glass transition temperature (° C.) of a polymer polymerized from the second-stage polymerizable monomer; and a third-stage polymerization step of carrying out suspension polymerization by further adding a polymerization initiator and a third-stage polymerizable monomer satisfying the following formula (2), when a polymerization conversion rate until the second-stage polymerization step becomes 95% or more:

$$Tg_{1+2} < Tg_3 \quad \text{Formula (2):}$$

wherein $Tg_{1+2}$ is a glass transition temperature (° C.) of a polymer polymerized from the first-stage and second-stage polymerizable monomers, and $Tg_3$ is a glass transition temperature (° C.) of a polymer polymerized from the third-stage polymerizable monomer.

5. The method for producing a polymerized toner according to claim 4, wherein, in the formula (2), $Tg_3$ is 10° C. to 100° C. higher than $Tg_{1+2}$.

6. The method for producing a polymerized toner according to claim 4, wherein a mass ratio of the first-stage polymerizable monomer to the second-stage polymerizable monomer is the first-stage polymerizable monomer:the second-stage polymerizable monomer=60:40 to 95:5.

7. The method for producing a polymerized toner according to claim 4, wherein, in the formula (1), $Tg_1$ is 5° C. to 250° C. higher than $Tg_2$.

* * * * *